US009808860B2

(12) United States Patent
Barre

(10) Patent No.: US 9,808,860 B2
(45) Date of Patent: Nov. 7, 2017

(54) TOOL FOR FIXING A CONNECTING HEAD ON AN ELECTRODE CASTED IN A MOLD, ASSOCIATED APPARATUS AND METHOD

(71) Applicant: AUBERT & DUVAL, Paris (FR)

(72) Inventor: Thierry Barre, Clermont Ferrand (FR)

(73) Assignee: AUBERT & DUVAL, Paris (FR)

( * ) Notice: Subject to any disclaimer, the term of this patent is extended or adjusted under 35 U.S.C. 154(b) by 13 days.

(21) Appl. No.: 14/652,635

(22) PCT Filed: Nov. 12, 2014

(86) PCT No.: PCT/EP2014/074379

§ 371 (c)(1),
(2) Date: Jun. 16, 2015

(87) PCT Pub. No.: WO2015/071312

PCT Pub. Date: May 21, 2015

(65) Prior Publication Data

US 2016/0250681 A1 Sep. 1, 2016

(30) Foreign Application Priority Data

Nov. 13, 2013 (FR) ..... 13 61088

(51) Int. Cl.

| | |
|---|---|
| ***B22D 11/08*** | (2006.01) |
| ***B22D 7/00*** | (2006.01) |
| ***H05B 7/102*** | (2006.01) |
| ***B22D 11/00*** | (2006.01) |

(52) U.S. Cl.

CPC ..... *B22D 11/083* (2013.01); *B22D 7/00* (2013.01); *B22D 7/005* (2013.01); *B22D 11/001* (2013.01); *B22D 11/081* (2013.01); *H05B 7/102* (2013.01)

(58) Field of Classification Search

CPC ..... B22D 11/081; B22D 11/083; H05B 7/102
USPC ..... 164/445
See application file for complete search history.

(56) References Cited

U.S. PATENT DOCUMENTS 3,525,381 A * 8/1970 Summers ..... B22D 11/083 164/425
6,273,179 B1 8/2001 Geltser et al.

FOREIGN PATENT DOCUMENTS

CN 101209487 A 7/2008
DE 2126993 A1 1/1973
EP 0231520 A1 * 8/1987 ..... B22D 11/08

(Continued)

OTHER PUBLICATIONS

International Search Report for PCT/EP2014/074379.

*Primary Examiner* — Kevin E Yoon
(74) *Attorney, Agent, or Firm* — Pearne & Gordon LLP

(57) ABSTRACT

The tool according to the invention comprises a connecting head (22) support (70) extending along a longitudinal axis (B-B'); a mold base (72), supported by the support (70), the mold base (72) defining an axial orifice for passage of the connecting head (22); an end-piece (74) for mounting the support (70) on a movement member for moving the tool in the mold; and a mechanism (76) for longitudinal immobilization of the connecting head (22) on the support (70). The mechanism (76) for longitudinal immobilization is longitudinally adjustable relative to the support (70) in order to immobilize the connecting head (22) relative to the support (70) in at least two different longitudinal positions along the longitudinal axis (B-B').

15 Claims, 5 Drawing Sheets

(56) References Cited

FOREIGN PATENT DOCUMENTS

RU 1457273 A1 11/1994

* cited by examiner

TOOL FOR FIXING A CONNECTING HEAD ON AN ELECTRODE CASTED IN A MOLD, ASSOCIATED APPARATUS AND METHOD

This application is a National Stage application of PCT international application PCT/EP2014/074379, filed on Nov. 12, 2014 which claims the priority of French Patent Application No. FR 13 61088 entitled "Tool for fixing a connecting head on an electrode casted in a mold, associated apparatus and method", filed Nov. 13, 2013, both of which are incorporated herein by reference in their entirety.

The present invention relates to a tool for fixing a connecting head on an electrode casted in a mold, comprising:

- a connecting head support extending along a longitudinal axis;
- a mold base, supported by the support, the mold base defining an axial orifice for passage of the connecting head;
- an end-piece for mounting the support on a member for moving the tool in the mold; and
- a mechanism for longitudinal immobilization of the connecting head on the support.

Such a tool is in particular designed to be used in a transferred arc plasma torch furnace for plasma arc melting cold hearth refining, or in an electron gun furnace for electron beam cold hearth refining.

In order to obtain high-quality metal alloys, with a base of scrap metal material, it is necessary to refine the metal in a cold hearth after melting it in a furnace of the aforementioned type. A metal electrode is next produced in the furnace, by continuous casting. An electrode is a cylindrical ingot intended for remelting.

The metal scraps are advantageously made from titanium alloy. More generally, they can be made from other metal materials, such as noble metals.

The electrode is remelted in a vacuum arc remelting furnace. In this furnace, the electrode is placed under vacuum and supplied with the melting current in a hearth called an ingot mold. An electric arc is created between the free end of the electrode and the bottom of the ingot mold, causing gradual-melting of the electrode.

The distance between the molten metal surface and the electrode is controlled during the melting.

In order to allow movement of the electrode and its electrical connection, it is known to weld a metal connecting head to its end, referred to as a "stub", after the electrode has been taken out of the melting and refining furnace.

However, the electrode is continuously casted in the molding ring of the melting and refining furnace while gradually removing the electrode from the mold using a pulling system. To that end, a mold with a dovetail shape is used.

In order to fix the connecting head, it is generally necessary to saw the end of the electrode to remove that dovetail, then carefully weld the connecting head. The weld serves both to bear the weight of the electrode and transmit the remelting current.

Such a method is not fully satisfactory. The multiple operations of the method require tedious and time-consuming operating manipulations.

In order to partially offset this problem, U.S. Pat. No. 6,273,179 describes a method in which a member for mounting the connecting head is welded to the end of the electrode, directly in the molding ring of the melting and refining furnace, during the formation of the electrode. The mounting member is initially housed in a cavity of the mold base.

Next, the connecting head is mechanically assembled on the mounting member and the assembly is inserted into the remelting furnace.

This method is therefore simpler to implement. It nevertheless requires a large number of manipulations and mounting operations that must be performed after casting, which consumes operating time.

Furthermore, given the configuration of the casting mold, the dimensions of the mounting member must precisely correspond to the complementary shape in the mold, which prevents any recycling of the mounting members. The method is therefore expensive.

One aim of the invention is to simplify the implementation of a method for remelting metal electrodes, cost effectively and while saving operating time.

To that end, the invention relates to a tool of the aforementioned type, characterized in that the mechanism for longitudinal immobilization is longitudinally adjustable relative to the support in order to immobilize the connecting head relative to the support in at least two different longitudinal positions along the longitudinal axis.

The tool according to the invention may include one or more of the following features, considered alone or according to any technically possible combination(s):

- the longitudinal immobilizing mechanism comprises at least one transverse immobilizing member for the connecting head and an assembly for locking the transverse immobilizing member on the support in each of the separate longitudinal positions;
- the support delimits at least one transverse passage opening, the transverse immobilizing member passing through the transverse opening, the locking assembly being positioned on an outer surface of the support, outside the transverse opening;
- the locking assembly comprises at least one lug engaged on the transverse immobilizing member, the lug being able to be disassembled with respect to the support, the locking assembly comprising a locking protrusion for locking the lug against the support, fixed on the support;
- the lug comprises a longitudinal fixing rod, the locking protrusion comprising a retaining yoke for retaining the longitudinal fixing rod;
- the transverse opening is a transverse slot;
- the tool comprises a mechanism for radial immobilization of the connecting head with respect to the longitudinal axis;
- the mold base comprises:
  - a first mold base part delimiting a first part of the contour of the axial passage orifice;
  - a second mold base part delimiting a second part of the contour of the axial passage orifice, the first part and/or the second part being mounted to be transversely movable on the support between an insertion configuration of the connecting head and a usage configuration;
  - a mechanism for guiding the movement of the first part and/or the second part with respect to the support;
- the mold base comprises a cooling assembly;
- the support comprises a tubular sleeve defining a central aperture for insertion of the connecting head, the mold base being mounted at one longitudinal end of the tubular sleeve, the mounting end-piece being situated at an opposite longitudinal end of the tubular sleeve;
- it bears a connecting head on an electrode, immobilized longitudinally relative to the support by the immobilizing mechanism, the connecting head protruding beyond the mold base through the axial passage orifice of the mold base.

The invention also relates to an installation for producing metal parts, comprising:

a refining hearth assembly, comprising at least one mold for forming an electrode by casting, a tool as described above, movably mounted in the mold, the tool bearing a connecting head;

the hearth assembly comprising a movement member for moving the tool in the mold, the mounting end-piece of the support of the tool being mounted on the movement member.

The installation according to the invention may include one or more of the following features, considered alone or according to any technically possible combination(s):

a furnace for remelting the electrode formed in the hearth assembly, the remelting furnace comprising an additional movement member for moving and electrically connecting the connecting head in the remelting furnace, able to receive the connecting head.

The invention also relates to a method for producing metal parts, comprising the following steps:

loading a connecting head in a tool as defined above;

adjusting the longitudinal position of the connecting head relative to the support in a selected longitudinal position;

immobilizing the connecting head in the selected longitudinal position, using the longitudinal immobilizing mechanism;

inserting the mold base into a mold for forming an electrode by casting, at least part of the connecting head protruding from, being flush with or being set back from the mold base;

pouring molten metal into the mold on said part of the connecting head;

moving the tool using a movement member of the mold to form the electrode.

The method according to the invention may comprise one or more of the following features, considered alone or according to any technically possible combination:

recovering the electrode equipped with the connecting head;

mounting the connecting head on an additional movement and electrical connection member of a remelting furnace;

remelting the electrode in the remelting furnace.

The invention will be better understood upon reading the following description, provided solely as an example and done in reference to the appended drawings, in which.

Figure 1:
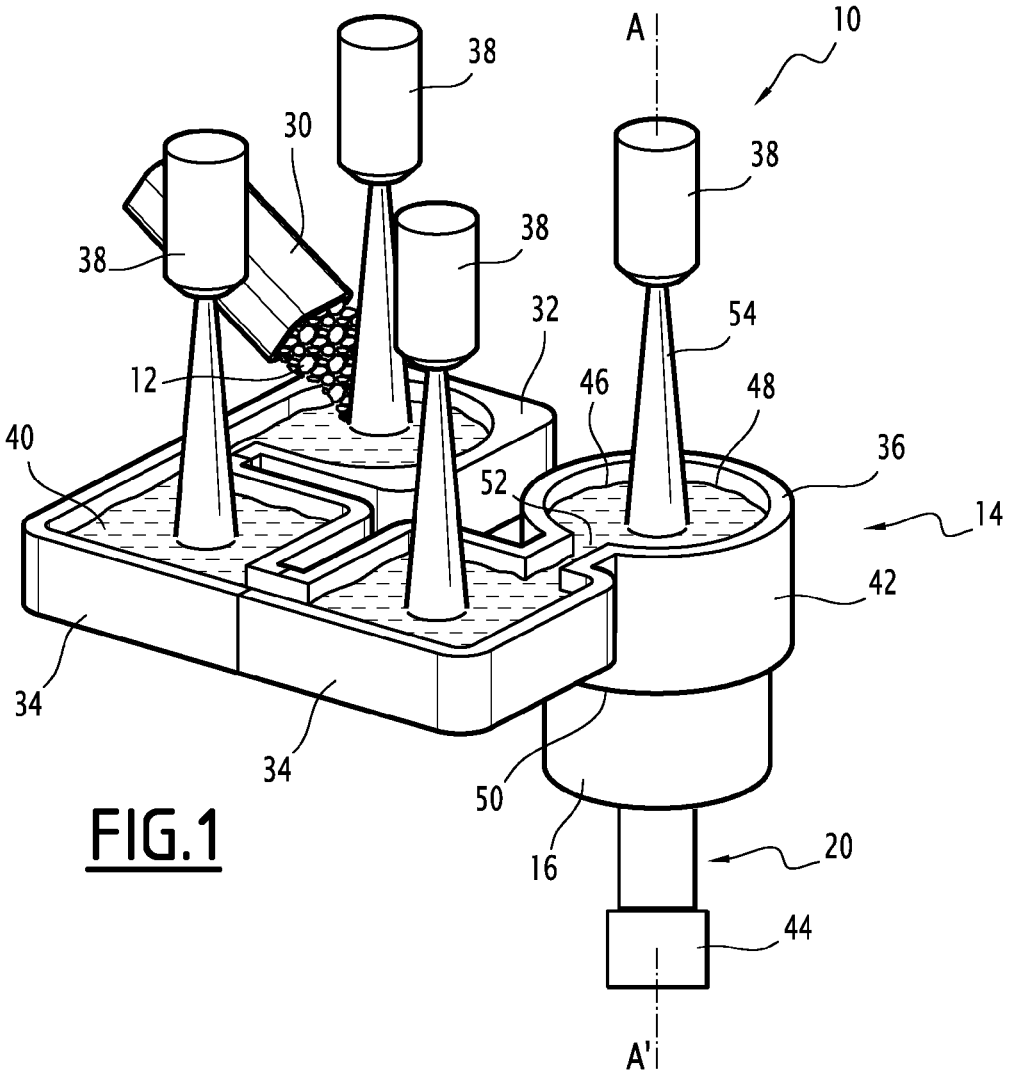
FIG. 1 is a partial diagrammatic perspective view of a melting and refining furnace in a first installation according to the invention.
Figure 2:
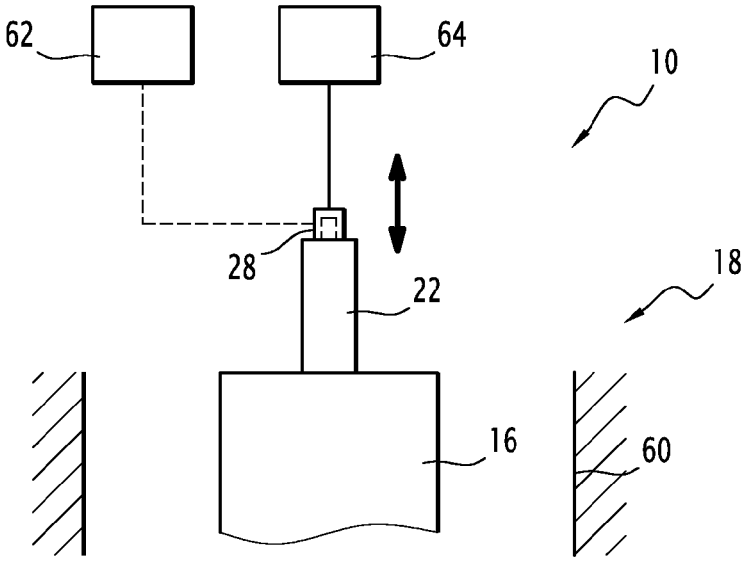
FIG. 2 is a diagrammatic sectional view of the relevant parts of a remelting furnace of the first installation according to the invention.

A first installation 10 according to the invention, designed to produce metal parts by refining and melting, is illustrated by FIGS. 1 and 2.

The metal parts formed by the installation 10 according to the invention are for example ingots or forms, in particular made from a metal alloy.

The metal parts are made from a source metal, in particular in the form of compacted metal shavings 12, in particular metal scraps.

The metal scraps are advantageously a titanium alloy. More generally, they can be made from other metal materials, such as noble metals.

The installation 10 comprises a hearth assembly 14, shown in FIG. 1, designed to form an electrode 16 by continuous casting, and a remelting furnace 18 for the electrode 16, the relevant parts of which are shown in FIG. 2.

Figure 3:
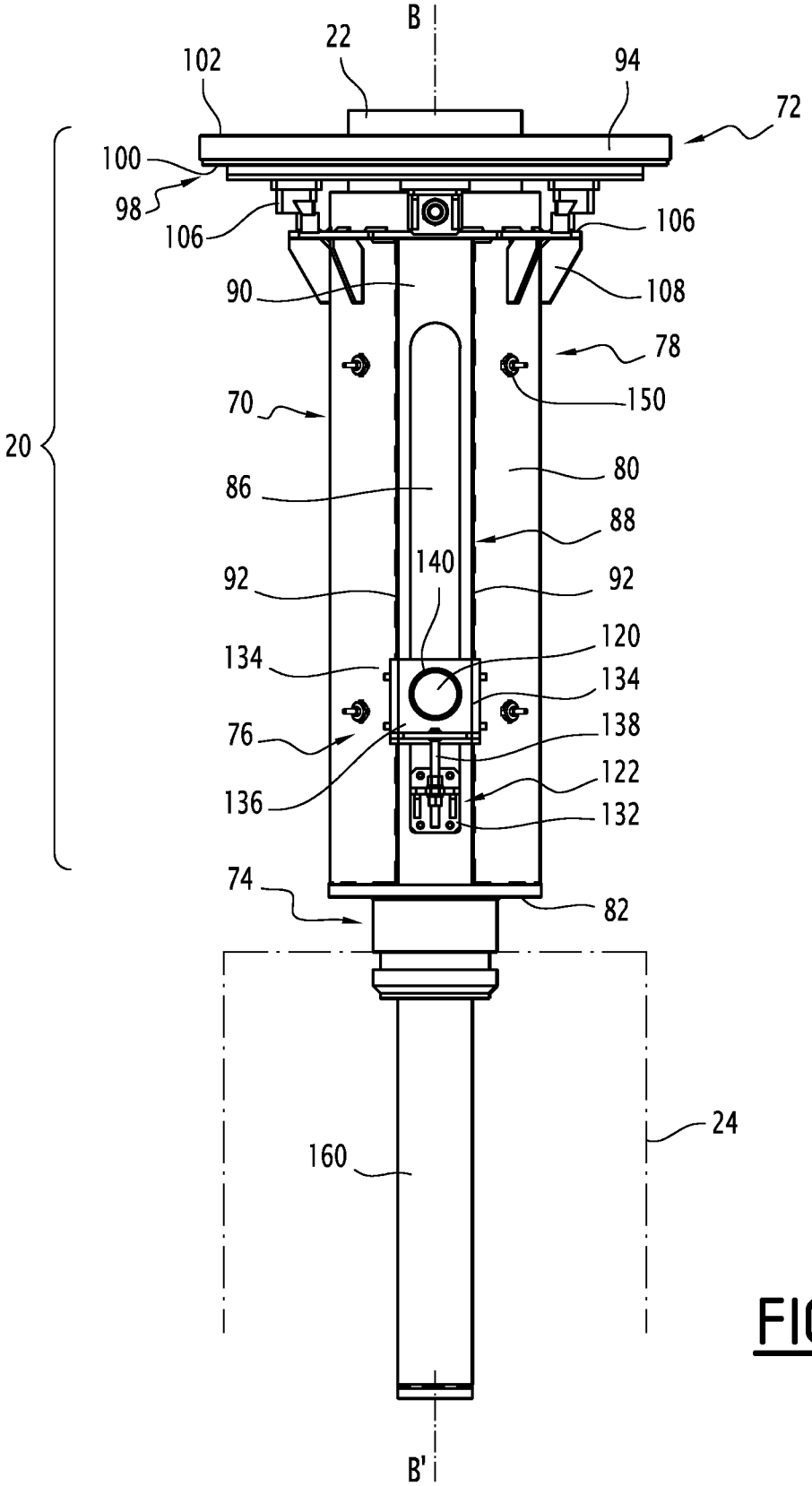
FIG. 3 is an elevation view of the first tool according to the invention.
Figure 4:
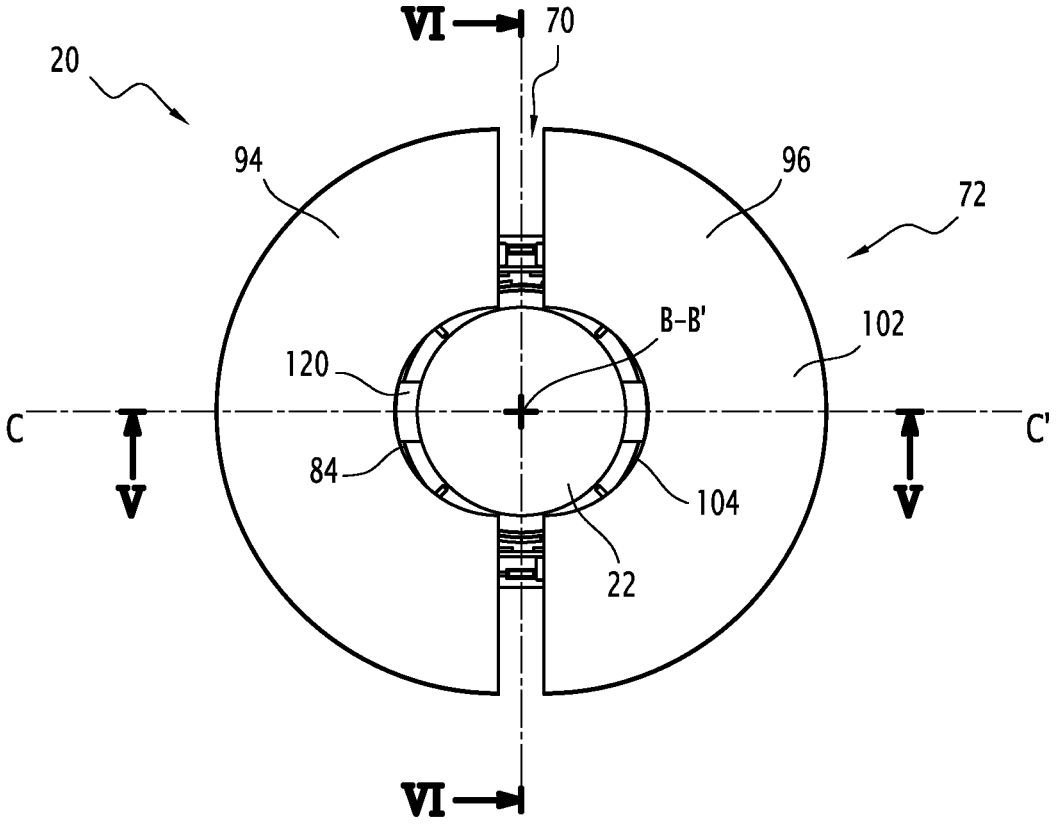
FIG. 4 is a top view of the tool according to the invention.
Figure 5:
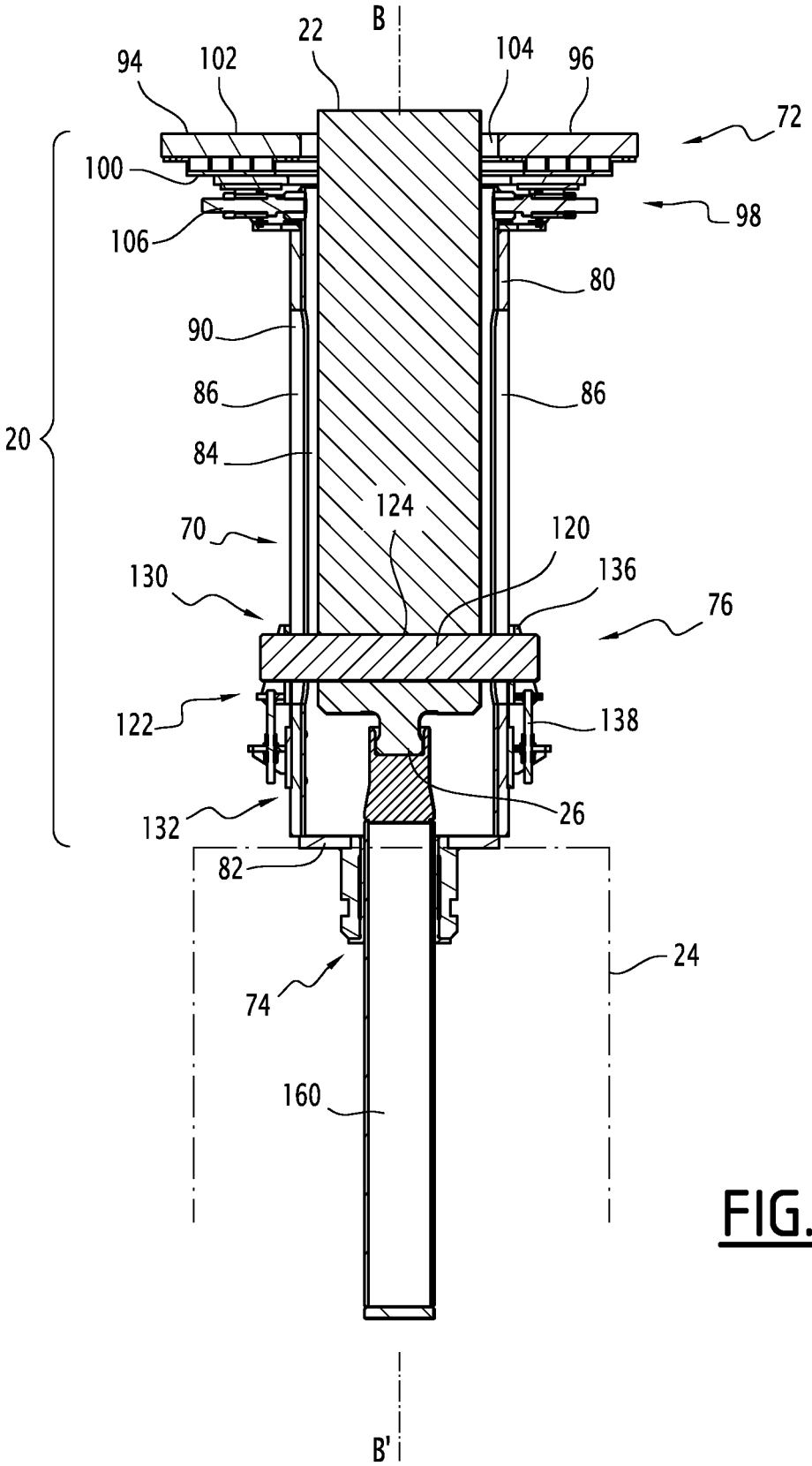
FIG. 5 is a sectional view in a median axial plane V of the tool according to the invention.

According to the invention, the installation 10 comprises a tool 20, as illustrated by FIGS. 3 to 5, that can be mounted in the molding ring of the hearth assembly 14, to receive a connecting head 22 on the electrode 16. The installation 10 advantageously comprises a station 24 for assembling the tool 20, shown in FIG. 3.

The electrode 16 is obtained by continuous casting in the hearth assembly 14.

The electrode 16 is advantageously cylindrical, with a diameter for example comprised between 100 and 1300 mm, advantageously between 700 mm and 900 mm, and in particular between 730 mm and 840 mm, and for example has a height comprised between 500 mm and 5000 mm, in particular between 2000 mm and 4000 mm.

The connecting head 22 is formed from a metal block, made from a metal able to melt with the metal making up the electrode 16. During the formation of the electrode 16 in the hearth assembly 14, the connecting head 22 thus fixes to one end of the electrode 16.

The connecting head 22 is referred to as a "stub". It is made in a single piece and is integral.

In this example, the connecting head 22 is cylindrical, with a diameter and height respectively smaller than the diameter and height of the electrode 16.

Owing to the tool 20 according to the invention, the connecting head 22 can have a variable height from one electrode 16 to another, for example comprised between 600 mm and 1300 mm.

Figure 6:
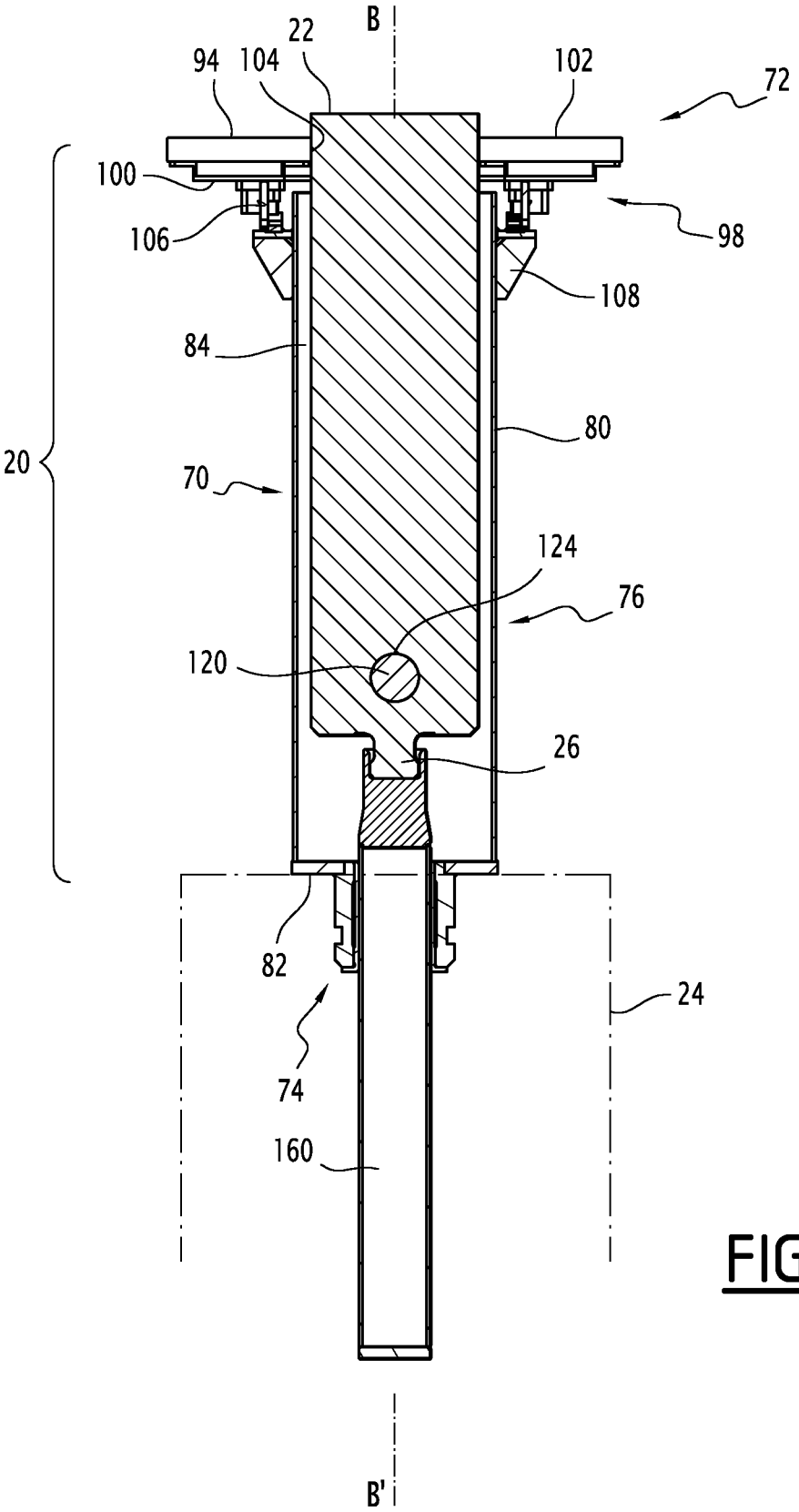
FIG. 6 is a sectional view in a median axial plane VI, perpendicular to the median axial plane V, of the tool according to the invention.

In the example illustrated in FIG. 6, the connecting head 22 comprises, at its free end, a form 26 for connecting to another movement and electrical connection member 28, situated in the remelting furnace 18, which will be described below.

Thus, the connecting head 22 can mechanically and electrically connect the movement and electrical connection member 28 to the electrode 16 during the remelting operation in the furnace 18, without any intermediate welding or mechanical assembly operation having to be carried out between the connecting head 22 and the electrode 16.

In reference to FIG. 1, the hearth assembly 14 comprises a source metal feed 30, a melting receptacle 32 receiving the metal from the feed 30, and at least one hearth 34 for refining the molten metal in the receptacle 32.

The hearth assembly 14 further comprises a molding ring 36 for continuous casting of the refined molten metal into each hearth 34, and a plurality of apparatuses 38 for melting the metal, positioned across from the melting receptacle 32, each refining hearth 34, and the molding ring 36, respectively.

The metal feed 30 emerges across from the melting receptacle 32. It is able to pour source metal in the form of shavings or solid scraps 12 into the receptacle 32, to melt the source metal using the melting apparatus 38.

At least one refining hearth 34 is connected upstream from the melting receptacle 32 to receive the molten metal coming from the receptacle 32, and to keep it in the form of a bath 40 of molten metal, using a melting apparatus 38. At least one refining hearth 34 is connected downstream from the molding ring 36 to distribute refined molten metal to the molding ring 36.

The molding ring 36 comprises a mold 42, designed to receive the tool 20, and a movement member 44, designed to move the tool 20 to allow continuous casting of the electrode 16.

The mold 42 delimits a molding cavity 46 with vertical axis A-A'. It is for example made from metal, in particular copper. It is connected to a cooling system (not shown), such as a cooling system using water circulation.

In this example, the mold 42 is cylindrical and ring-shaped.

The mold 42 upwardly emerges via an upper opening 48 placed across from a melting apparatus 38, and downwardly emerges via a lower draft opening 50 for pulling the electrode 16. It has an upper lateral passage 52 for distributing molten metal, connected to a hearth 34.

The movement member 44 preferably comprises a jack comprising a cylinder and a cylinder rod (not shown) or a similar electromechanical system.

The tool 20 can be reversibly mounted on the movement member 44, in order to be translated along the axis A-A' by the movement member 44.

In the example shown in FIG. 1, the hearth assembly 14 is a transferred arc plasma torch furnace for plasma arc cold hearth refining.

In that case, each melting apparatus 38 is a plasma torch. The plasma torch can produce a plasma beam 54 oriented downward, toward the melting receptacle 32, toward each refining hearth 34, and toward the molding ring 36 through the upper opening 48, respectively.

Alternatively, the hearth assembly 14 is used in an electron gun furnace for electron beam cold hearth refining.

In that case, each melting apparatus 38 is able to produce an electron beam 54 oriented downward, toward the melting receptacle 32, each refining hearth 34 and the molding ring 36 through the upper opening 48, respectively.

The remelting furnace 18 is generally a vacuum arc remelting furnace.

Aside from the movement and electrical connection member 28 described above, it comprises a metal hearth 60 (also called "ingot mold"), in which a partial vacuum is produced, an electricity source 62, electrically connected to the movement and electrical connection member 28, and an assembly 64 for actuating the movement and electrical connection member 28.

The source 62 is electrically connected to the electrode 16 through the movement member 28, and through the connecting head 22, to create an electric voltage, and an electric arc between the free end of the electrode 16 and a metal surface opposite it, in the bottom of the hearth 60.

The electric arc causes gradual melting of the free end of the electrode 16. The actuating assembly 64 is able to move the electrode 16 relative to the metal surface using the movement and electrical connection member 28 and using the connecting head 22, to control the distance separating the free end of the electrode 16 and the metal surface at all times during the gradual melting of that electrode 16.

In reference to FIGS. 3 to 6, the tool 20 comprises a support 70 for receiving the connecting head 22, with a vertical longitudinal axis B-B' in FIG. 3.

It comprises a mold base 72, carried by the support 70 at an upper end of the support 70 and a mounting end-piece 74 for mounting the support 70 on the movement member 44, situated at the lower end of the support 70.

According to the invention, the tool 20 further comprises a mechanism 76 for longitudinal immobilization of the connecting head 22 relative to the support 70, which can be longitudinally adjusted, to immobilize the connecting head 22 in a plurality of different longitudinal positions along the longitudinal axis B-B'.

The tool 20 also comprises a mechanism 78 for radial immobilization of the connecting head 22 relative to the longitudinal axis B-B'.

In this example, the support 70 comprises a tubular sleeve 80 with axis B-B', downwardly partially closed off by a bottom wall 82.

The tubular sleeve 80 defines a central aperture 84 for receiving the connecting head 22 and transverse through mounting openings 86 for the longitudinal immobilization mechanism 76.

In this example, the sleeve 80 has, around each transverse opening 86, a longitudinal bearing rib 88 for the immobilizing mechanism 76, through which the transverse opening 86 extends.

The central aperture 84 extends along the axis B-B'. It upwardly emerges across from the mold base 72, at the upper end of the support 70.

In this example, the central aperture 84 is downwardly partially closed off by the bottom wall 82. It emerges axially downward through the mounting end-piece 74.

The tubular sleeve 80 here defines two transverse openings 86 positioned across from each other, on either side of the axis B-B'.

Each transverse opening 86 emerges in the central aperture 84, toward the axis B-B', and outside the sleeve 80, separated from the axis B-B'.

In this example, each transverse opening 86 is a longitudinal slot with axis B-B' extending over part of the length of the sleeve 70.

The length of the transverse opening 86, considered along the axis B-B', is for example comprised between 50% and 75% of the length of the sleeve 80.

Each longitudinal rib 88 protrudes radially relative to the axis B-B' on the outer surface of the sleeve 80.

The rib 88 defines a flat portion 90, designed for bearing of the mechanism 76, and longitudinal edges 92 for affixing the mechanism 76.

As illustrated by FIGS. 3 to 6, the mold base 72 comprises a first half-part 94 and a second half-part 96, which are mounted movably relative to one another and relative to the support 70, between an open configuration for inserting the connecting head 22 and a closed configuration for introducing the connecting head 22 into the molding ring 36.

The mold base 72 further comprises a mechanism 98 for guiding the movement of each half-part 94, 96, and an assembly 100 for cooling each half-part 94, 96.

Each half-part 94, 96 is made from a metal material similar to that making up the mold 42 of the molding ring 36, for example copper.

In this example, each half-part 94, 96 is formed by a half-disc delimiting a central notch. It is so generally C-shaped.

Each half-part 94, 96 defines a substantially planar upper surface 102, designed to receive molten metal at the bottom of the mold 42, and cool it to solidify the metal. The upper surface 102 advantageously extends in a plane substantially perpendicular to the axis B-B'.

The half-parts 94, 96 are transversely movable toward the axis B-B' between the open configuration and the closed configuration, advantageously in translation along an axis C-C' perpendicular to the axis B-B', shown in FIG. 4.

The half-parts 94, 96 define an axial orifice 104 between them for introducing the connecting head 22 into the central aperture 84 of the support 70.

In the open configuration, shown in FIG. 4, the introduction orifice 104 has an expanse larger than that which it has in the closed configuration.

In the closed configuration, the half-parts 94, 96 are substantially in contact with one another. The introduction orifice 104 is substantially closed and has a contour substantially conjugated with the outer contour of the connecting head 22.

Furthermore, the half-parts 94, 96 have an outer contour substantially conjugated to the inner contour of the mold 42.

The guide mechanism 98 comprises guideways 106 fixed on the outer surface of the sleeve 80 by brackets 108. Each half-part 94, 96 is supported by two guideways 106 positioned on either side of the axis B-B'.

The cooling assembly 100 comprises hollow plates 110 delimiting coolant flow channels, and coolant supply connectors (not shown). The hollow plates 110 are attached below each half-part 94, 96.

A coolant, for example water, can flow in the channels defined between the hollow plates 110 and each half-part 94, 96, in order to cool the upper surface 102.

According to the invention, the longitudinal immobilizing mechanism 76 comprises a transverse member 120 for immobilizing the connecting head 22, and a locking assembly 122 for locking the transverse immobilizing member 120 on the support 70 in a longitudinal position that can be adjusted along the axis B-B'.

In this example, the transverse member 120 is formed by a pin.

The transverse member 120 is mounted through a through hole 124 arranged transversely in the connecting head 22, and through each transverse opening 86. Its ends protrude transversely on either side of the support 70, to be grasped by the locking assembly 122.

The locking assembly 122 comprises removable lugs 130 for engaging on the transverse member 120 and, for each lug 130, a retaining yoke 132 retaining the locking lug 130 on the support 70.

The locking assembly 122 further advantageously comprises additional fixing members 134 for fixing each lug 130 on the support 70.

Each lug 130 comprises a clevis 136 for engaging one end of the transverse member 120 and a fixing rod 138 on the yoke 132.

The clevis 136 delimits a passage 140 receiving one end of the transverse member 120 to lock it in translation along the axis B-B'.

The fixing rod 138 protrudes relative to the clevis 136. It can engage in the yoke 132, in order to keep the clevis 136 axially in position along the axis B-B'.

The yoke 132 is fixed on the support 70, advantageously under the through opening 86.

The complementary fixing members 134 are formed by screw systems mounted through the clevis 136 in the support 70, advantageously at holes arranged in the lateral edges 92 of the rib 88.

Each lug 130 can be reversibly assembled on the support 70, between a disassembled configuration separated from the support 70 and a plurality of configurations mounted on the support 70, spaced along the axis B-B'.

In the configuration mounted on the support 70, the passage 140 of the clevis 136 receives the end of the transverse member 120. The rod 138 protrudes relative to the clevis 136 to be received in the yoke 132. It is maintained in the yoke 132 by removable fixing members, of the nut type.

The clevis 136 is pressed against the support 70, advantageously at the flat portion 90. It is kept in the pressed position by the complementary fixing members 134.

In the example shown in FIG. 3, each lug 130 can be fixed on the support 70 in a discrete number of mounted configurations, longitudinally spaced apart from one another along the axis B-B'.

These configurations are defined by the position of the holes arranged in the lateral edges 92 of the rib 88.

Alternatively, the position of the mounted configuration can be adjusted continuously along the transverse opening 86 along the axis B-B'.

The longitudinal adjustment of the lugs 130 modifies the relative position of the connecting head 22 with respect to the support 70, and with respect to the mold base 72, so that the length of the segment of the connecting head 22 protruding above the mold base 72 is constant, irrespective of the length of the connecting head 22.

This allows the use of connecting heads 22 with various sizes, in particular allowing already-used connecting heads 22 to be recycled.

The radial immobilization mechanism 78 comprises adjustable pressure screws 150 inserted radially through the support 70 in the central aperture 84.

Each pressure screw 150 can bear radially on the connecting head 22, to lock it radially relative to the axis B-B' in at least one direction.

In reference to FIG. 3, the assembly station 24 comprises an assembly base 160 for assembling the connecting head 22 and the support 70, and a handling assembly (not shown).

A method for producing a metal part in the installation 10 according to the invention will now be described.

The method comprises a phase for assembling the tool 20, a phase for forming an electrode 16 in the hearth assembly 14 using the tool 20, then a phase for remelting the electrode 16 in the remelting furnace 18.

The assembly phase can be carried out in masked time outside the main enclosure receiving the copper hearth assembly 14.

It first comprises positioning the support 70 on the assembly base 160. Advantageously, the free end of the assembly base 160 protrudes in the central aperture 84 through the mounting end-piece 74.

The half-parts 94, 96 of the mold base 72 are then placed in their open configuration.

Then, the connecting head 22 is introduced from the top into the central aperture 84 through the axial orifice 104 defined between the half-parts 94, 96.

The connecting head 22 is reversibly fixed on the free end of the assembly base 160, in the central aperture 84.

The axial position of the connecting head 22 along the axis B-B' is then adjusted by moving the assembly base 160 relative to the support 70, based on the desired height of the segment of the head 22 protruding past the mold base 72, flush with the mold base 72 or set back from the mold base 72.

Then, the transverse member 120 is successively introduced into a first transverse opening 86, the through hole 124, then a second transverse opening 86.

The free ends of the transverse member 120 then protrude transversely outside the support 70 through the respective transverse openings 86.

The lugs 130 are next engaged around each free end of the transverse member 120 and fixed against the support 70.

To that end, each free end of the transverse member 120 is introduced into a passage 140 defined in the clevis 136. At the same time, the fixing rod 138 is inserted into a retaining yoke 132.

The clevis 136 is pressed against the flat portion 90. The fixing members for fixing the rod 138 on the yoke 132 are placed. The additional fixing members 134 between the clevis 136 and the rib 88 are also assembled.

Each lug 130 occupies a configuration mounted on the support 70, in a predetermined axial position.

The connecting head 22 is then axially immobilized along the axis B-B' in a chosen position, by means of the locking assembly 122 comprising the transverse member 120 and the lugs 130.

Then, the half-parts 94, 96 are placed in the closed configuration surrounding the end of the connecting head 22.

The tool 20 comprising the connecting head 22 is then conveyed to the molding ring 36 of the hearth assembly 14.

The mounting end-piece 74 is mounted on the movement member 44. Coolant supply conduits (not shown) are connected to the cooling assembly 100.

The movement member 44 is actuated to place the mold base 72 in the mold cavity 46 defined in the mold 42.

The end of the connecting head 22 is then partially melted, for example by the beam 54 of the melting apparatus 38 situated above the molding ring 36.

Molten metal from a refining hearth 34 is next introduced into the molding cavity 46 to fill the molding cavity 46 gradually. During that casting, the connecting head 22 becomes welded on the electrode 16, with no outside intervention.

Next, the movement member 44 is actuated to jointly pull the connecting head support 70, the mold base 72 and the electrode 16 being formed on the mold base 72 downward. The continuous casting of the electrode 16 is done gradually.

Once the electrode 16 is formed, it is removed from the hearth assembly 14, the connecting head 22 already being welded to one of its ends.

After disassembly of the tool 20 according to the invention, the electrode 16, equipped with its connecting head 22, is introduced into the remelting furnace 18 and is mounted directly on the movement and electrical connection member 28 of the remelting furnace 18.

No welding or mechanical assembly operation is necessary, which considerably simplifies the implementation of the method, and decreases the cycle time.

The connecting head 22 is further electrically connected to the electricity source 62, to cause remelting of the electrode 16 in the hearth 60 and form the desired metal part.

The tool 20 according to the invention is therefore particularly easy to use and adapt to a wide variety of connecting heads 22. This allows the connecting heads 22 to be recycled.

The tool 20 can be mounted during masked time, increasing the productivity of the method.

Furthermore, the connecting head 22 is fixed on the electrode 16 directly during the manufacture thereof, with no outside intervention, and can be mounted directly in the remelting furnace 18, with no additional mechanical assembly required.

The invention claimed is:

1. A tool for fixing a connecting head on an electrode casted in a mold, comprising:

a connecting head support extending along a longitudinal axis;

a mold base, supported by the support, the mold base defining an axial orifice for passage of the connecting head;

an end-piece for mounting the support on a movement member for moving the tool in the mold; and a mechanism for longitudinal immobilization of the connecting head on the support;

wherein the mechanism for longitudinal immobilization is longitudinally adjustable relative to the support in order to immobilize the connecting head relative to the support in at least two different longitudinal positions along the longitudinal axis.

2. The tool according to claim 1, wherein the longitudinal immobilizing mechanism comprises at least one transverse immobilizing member for the connecting head and an assembly for locking the transverse immobilizing member on the support in each of the separate longitudinal positions.

3. The tool according to claim 2, wherein the support delimits at least one transverse passage opening, the transverse immobilizing member passing through the transverse opening, the locking assembly being positioned on an outer surface of the support), outside the transverse opening.

4. The tool according to claim 3, wherein the locking assembly comprises at least one lug engaged on the transverse immobilizing member, the lug being able to be disassembled with respect to the support, the locking assembly comprising a locking protrusion for locking the lug against the support, fixed on the support.

5. The tool according to claim 4, wherein the lug comprises a longitudinal fixing rod, the locking protrusion comprising a retaining yoke for retaining the longitudinal fixing rod.

6. The tool according to claim 3, wherein the transverse opening is a longitudinal slot.

7. The tool according to claim 1, comprising a mechanism for radial immobilization of the connecting head with respect to the longitudinal axis.

8. The tool according to claim 1, wherein the mold base comprises:

a first mold base part delimiting a first part of the contour of the axial passage orifice;

a second mold base part delimiting a second part of the contour of the axial passage orifice, the first part and/or the second part being mounted to be transversely movable on the support between an insertion configuration of the connecting head and a usage configuration;

a mechanism for guiding the movement of the first part and/or the second part with respect to the support.

9. The tool according to claim 1, wherein the mold base comprises a cooling assembly.

10. The tool according to claim 1, wherein the support comprises a tubular sleeve defining a central aperture for insertion of the connecting head, the mold base being mounted at one longitudinal end of the tubular sleeve, the mounting end-piece being situated at an opposite longitudinal end of the tubular sleeve.

11. The tool according to claim 1, bearing a connecting head on an electrode, immobilized longitudinally relative to the support by the immobilizing mechanism, the connecting head protruding beyond the mold base through the axial passage orifice of the mold base.

12. An installation for producing metal parts, comprising:

a refining hearth assembly, comprising at least one mold for forming an electrode by casting, a tool according to claim 1, movably mounted in the mold, the tool bearing a connecting head;

the hearth assembly comprising a movement member for moving the tool in the mold, the mounting end-piece of the support of the tool being mounted on the movement member.

13. The installation according to claim 12, comprising a furnace for remelting the electrode formed in the hearth assembly, the remelting furnace comprising:

an additional movement member for moving and electrically connecting the connecting head in the remelting furnace, able to receive the connecting head.

14. A method for producing metal parts, comprising the following steps:

loading a connecting head in a tool according to claim 1;

adjusting the longitudinal position of the connecting head relative to the support in a selected longitudinal position;

immobilizing the connecting head in the selected longitudinal position, using the longitudinal immobilizing mechanism;

inserting the mold base into a mold for forming an electrode by casting, at least part of the connecting head protruding from, being flush with or being set back from the mold base;

pouring molten metal into the mold on said part of the connecting head;

moving the tool using a movement member of the mold to form the electrode.

15. The method according to claim 14, comprising the following steps:

recovering the electrode equipped with the connecting head;

mounting the connecting head on an additional movement and electrical connection member of a remelting furnace;

remelting the electrode in the remelting furnace.

* * * * *